US006398087B2

(12) United States Patent
Solich

(10) Patent No.: US 6,398,087 B2
(45) Date of Patent: Jun. 4, 2002

(54) EMBROIDERY AID AND ASSEMBLY

(76) Inventor: Catherine Solich, 829 SW. 15th Ave., Cape Coral, FL (US) 33991

( * ) Notice: Subject to any disclaimer, the term of this patent is extended or adjusted under 35 U.S.C. 154(b) by 0 days.

(21) Appl. No.: 09/866,064

(22) Filed: May 29, 2001

Related U.S. Application Data

(60) Provisional application No. 60/210,402, filed on Jun. 9, 2000.

(51) Int. Cl.[7] ..... A41M 31/00; G02B 7/02

(52) U.S. Cl. ..... 223/109 R; 223/108; 359/811

(58) Field of Search ..... 359/811, 819, 359/810; 223/108, 109 R, 106, 1

(56) References Cited

U.S. PATENT DOCUMENTS 2,166,988 A * 7/1939 Fosdik ..... 359/811
3,428,483 A * 2/1969 DelPesco ..... 359/811
3,822,088 A * 7/1974 Steiner ..... 359/811
4,190,032 A * 2/1980 Wortley ..... 359/811
5,169,041 A * 12/1992 Tan ..... 223/109 R

* cited by examiner

*Primary Examiner*—Bibhu Mohanty

(57) ABSTRACT

The invention is directed toward an embroidery and aid assembly that is made up of a plate having an aperture therein. A magnifying glass is mounted over the aperture and maintained over the base plate at a slight spacing so that an embroidery pattern can slipped under the magnifying glass and over the base plate. The bottom of the magnifying glass has a sight line thereon so that a reader can clearly see the stitch progression and clearly identify a particular line on the pattern in the process of stitching. The bottom plate has various ways of retaining embroidery implements thereon, thus making it an assembly, while the magnifying glass is an aid to the embroidery process. A bag is designed to contain the above noted embroidery assembly, thus making it kit. The bag has on one edge thereof a hook to hang the bag at a point of sale. Another edge of the bag has a zipper thereon, while the opposite edge of the zipper edge has a pocket fold thereon to enable the bag to expand to a larger size.

4 Claims, 4 Drawing Sheets

EMBROIDERY AID AND ASSEMBLY

CROSS REFERENCE TO RELATED APPLICATIONS

This Application is a Continuation of the Provisional Application Ser. No. 60/210,402 filed on Jun. 9, 2000.

BACKGROUND OF THE INVENTION

The invention at hand pertains to an embroidery aid and an assembly or an organizer. That means, that at least two different embodiments of the invention are involved. One embodiment is directed to an aid which is used during the act of embroidery, while the other embodiment is used to keep all necessary paraphernalia at hand which are essential while embroidering. That is, the different colored threads, the needles, a pair of scissors, a needle threader and maybe a thimble e.t.c.

During the act of embroidery, one normally uses a pattern which is difficult to read because of the fine print and very close lines that outline the adjacent stitches and the stitches in the lines that follow because of one constantly looking at a certain line in the pattern and then back to the embroidery itself and then back again, it is very difficult to remember or to recapture the line one is working on.

On the other hand, the various items that are required or involved to do the embroidery itself are not always handy or in the same location or organized in a certain manner. This invention will always have all the items handy regardless of the location where the embroidery takes place.

One solution has been the use of the so-called sewing boxes where all items are stored in one place. However, sewing boxes are never neat and organized wherein all items are bunched together. The second embodiment of the invention overcomes this problem. There are known elongated prior art magnifiers which have magnets on each end and together with a metal plate are used to hold a pattern in place.

BRIEF SUMMARY OF THE INVENTION

The organizer and embroidery aid and assembly of the invention is compact and is travel sized. It eliminates the need for a needle case, a thread organizer, a magnifier with a line guide, magnetic board and a folding stand. The organizer system is light weight, purse size and it is convenient to use. It is a unit-all-in-one because it contains an elongated magnifier with a guide thereon and needles, scissors and the necessary thread. It also fits on a table and is great for people who like to have something to do while waiting in a doctor's office, stuck in traffic, waiting in a car for children to finish up the sports practice. It is particular great for people on the run-just grab it and go. They don't have to search for all the little things that are involved in the process of embroidering because it is all organized into one unit.

DETAILED DESCRIPTION OF THE PREFERRED EMBODIMENT OF THE INVENTION

Figure 1:
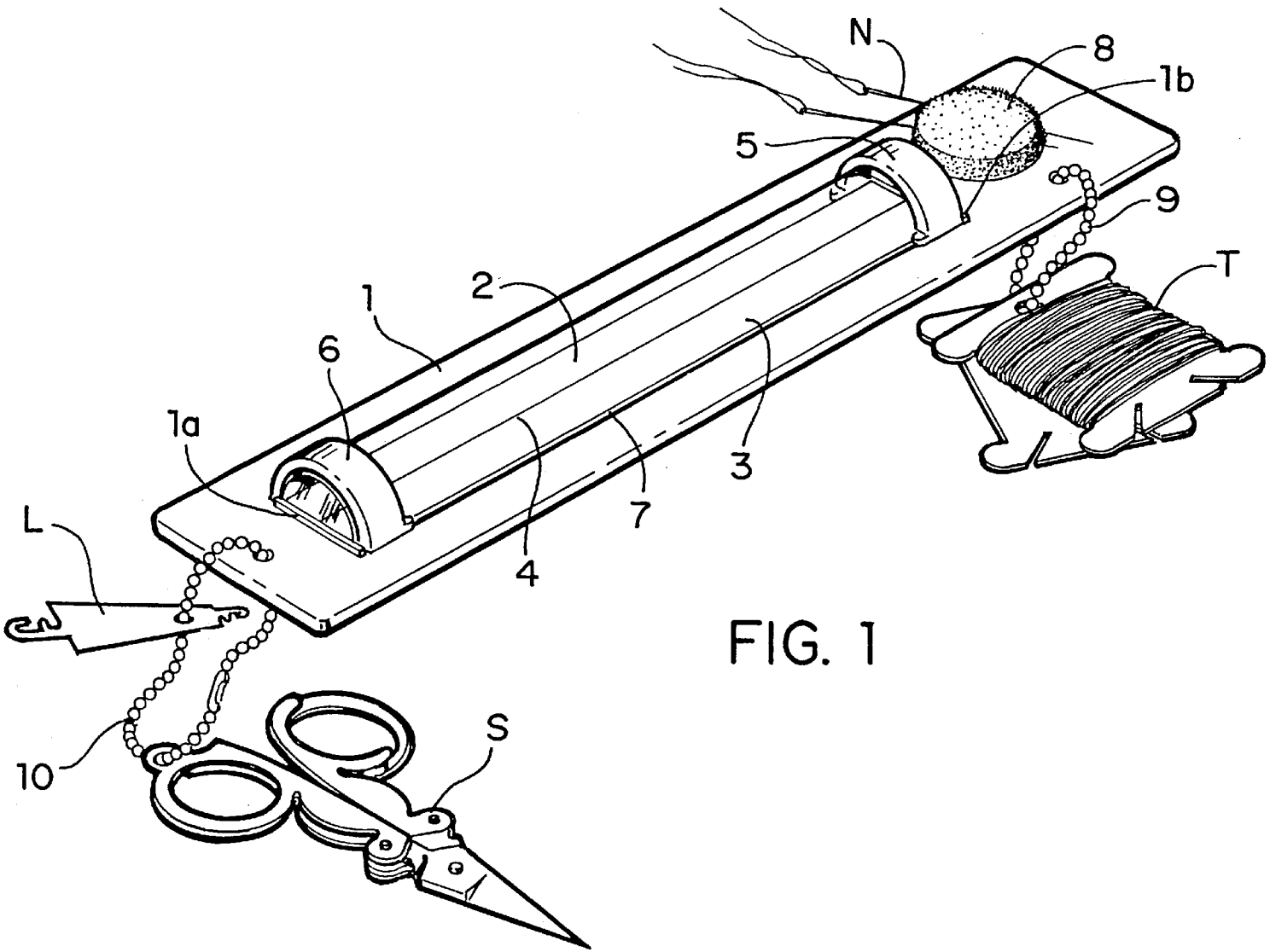
FIG. 1 illustrates the complete embroidery aid and assembly device.

Turning now to FIG. 1 which shows the embroidery aid and assembly device in a perspective view. The device includes a basic bottom plate 1 which can be made of any plastic or metal material. The plate 1 has a central and oblong aperture therein. A top rounded and elongate magnifying glass 3 is placed over the basic plate 1 and the aperture 3. It is important that the magnifying glass 3 be spaced above the base plate 1 to some extent as is shown at 7. The reason for this spacing will be explained with reference to FIG. 2. The spacing of the magnifying glass above the plate is accomplished by end retainers and spacers 1*a* and 1*b* at each end of the aperture 2. The magnifying glass 3 is also held in place by end bows 5 and 6 which hold the magnifying glass against the retainer and spacers 1*a* and 1*b*. The magnifying glass 3 can easily be installed and removed by bending the base plate 1. The magnifying glass 3 has at a flat bottom thereof a reading line which again will be explained below with reference to FIG. 2. The reason why this device is called an assembly device is because all implements and supplies necessary in the process of embroidery are all contained on the base plate 1. Thus, for example, there is a needle pad 8 attached to the plate 1 to receive and retain the needles N. There is a chain 9, for example, to receive and retain any number of the cards T having threads thereon. On the other side of the base plate 1, there is shown a chain 10 retaining the scissors S or a needle threader L. Any other implements desirable and necessary for any embroidery project can thus also be retained on the base plate 1. The specific location of these retainers on the plate 1 is immaterial in order to practice the invention.

Figure 2:
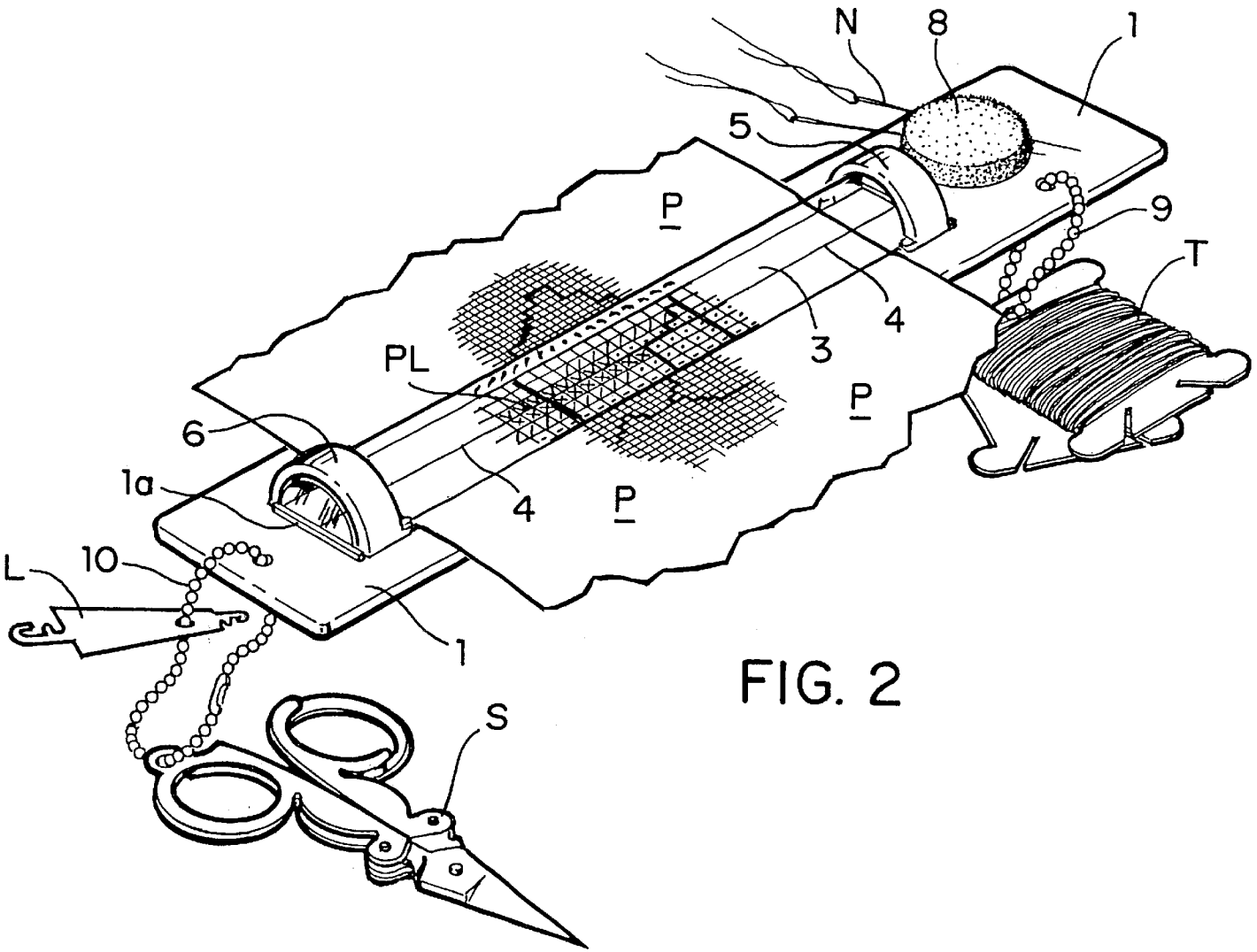
FIG. 2 shows the same device of FIG. 1 with a pattern sheet installed.

Turning now to FIG. 2 which shows the invention acting as an aid to the embroidery process. The same reference characters that were used in FIG. 1 also appear in this FIG. 2 to identify the same elements. It is a well known fact that the patterns that contain the stitch instructions are in small print and the print is very crowded. Even if the pattern is somewhat readable, It is very difficult to distinguish the stitches between the various lines or to remember any particular line that is presently the proper stitch indicator. Therefore, the magnifying glass 3 has been added. In order to identify any particular line in progress, the sight line 4 has been added to the bottom of the magnifying glass 3.

The pattern P is shown as having been slipped under the magnifying glass 3 and is well accommodated thereunder because of the spacing 7 created between the bottom of the magnifying glass 3 and the top of the plate. The aperture 2 in the plate 1 is not necessary and a solid planar bottom plate 1 would suffice. However, the spacing 7 is left deliberately slight or narrow to create some friction between the plate and the bottom of the glass relative to a pattern sheet. Therefore, to aid in the installation of the pattern sheet under the magnifying glass 3 and the top of the plate 1, the aperture 2 is instrumental in moving the pattern sheet along because the user's fingers can reach into the aperture 2 from the bottom of the plate 1 and help the sheet along. Of course, the advantage of having a magnifying glass 3 is readily apparent because the pattern lines PL appear magnified through the top of the magnifying glass 3 which then is an aid in the embroidery process and less stitching mistakes will occur while speeding up the stitching process at the same time.

Figure 3:
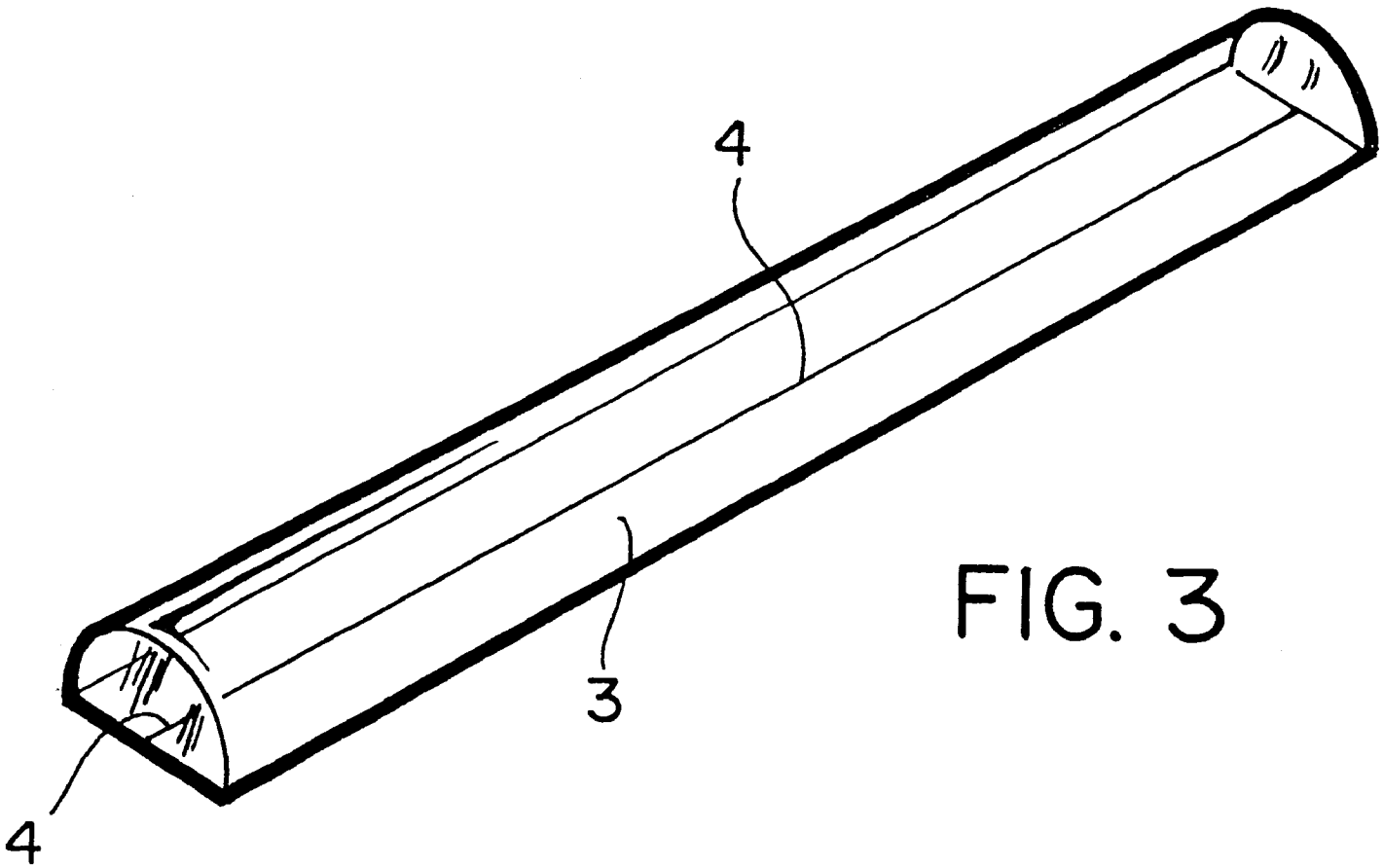
FIG. 3 shows the magnifying glass by itself.

FIG. 3 is added to clearly show the outline of the magnifying glass 3 with the line 4 acting as a reading line as was explained above.

Figure 4:
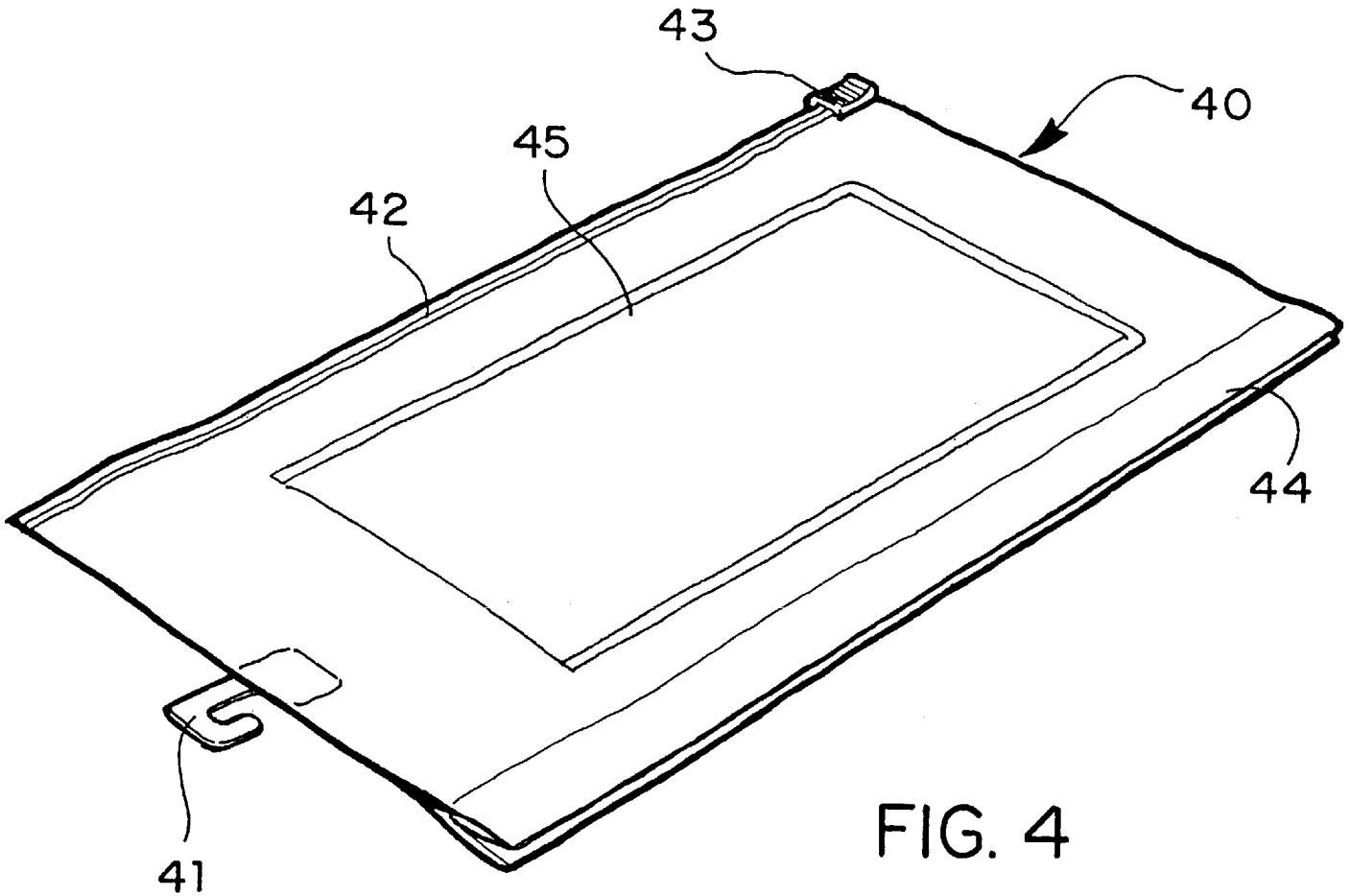
FIG. 4 shows a bag to be used to contain the device of FIG. 2.

Turning now to FIG. 4, there is shown a see-through or clear view bag 40 having a hook 41 on one end for the purpose of hanging an assembled embroidery project on a peg in a display at the point of sale. The bag has at a long side thereof a zipper 42 with a slide 43 to operate the same. Finally, the bag on the edge opposite the zipper has a pocket fold or a gusset to give the bag a chance to expand to accommodate all of the content when necessary. In addition it is desirable that a clear view pocket 45 be placed over an outside surface of the bag so that any pattern with a logo thereon can be stored therein and can be exhibited through the clear view plastic for filing purposes together with other like bags.

What I claim is:

1. A hand-held embroidery aid and assembly device including a planar bottom plate, a magnifying glass placed over and in parallelism with said planar bottom plate, means for holding said magnifying glass in place over said planar bottom plate, means for slightly spacing said magnifying glass from said planar bottom plate, an embroidery pattern adapted to be slipped under said magnifying glass and over said planar bottom plate.

2. The embroidery aid and assembly device of claim 1 including means for retaining embroidery implements on said bottom plate.

3. The embroidery aid and assembly of claim 1 including an aperture placed in said planar bottom plate and under said magnifying glass.

4. A kit for containing the embroidery and aid assembly of claim 2 comprising a clear view bag having a hook on one edge thereof, a zipper located on another edge and a pocket fold located at an edge opposite from said zipper edge, an additional clear view pocket is placed on an outside surface of said bag.

* * * * *